United States Patent [19]

Komori et al.

[11] 3,989,236

[45] Nov. 2, 1976

[54] COPYING MACHINE

[75] Inventors: Shigehiro Komori, Yokohama; Masao Ariga, Chofu; Hiroshi Nitanda, Tokyo, all of Japan

[73] Assignee: Canon Kabushiki Kaisha, Tokyo, Japan

[22] Filed: Dec. 10, 1974

[21] Appl. No.: 531,381

[30] Foreign Application Priority Data

Dec. 13, 1973 Japan ..... 48-140955
Jan. 8, 1974 Japan ..... 49-5508

[52] U.S. Cl. ..... 271/4; 271/3.1; 271/9; 271/127; 271/160; 271/163; 271/218; 355/24

[51] Int. Cl.[2] ..... B65H 3/44; B65H 1/12

[58] Field of Search ..... 271/163, 162, 160, 170, 271/3, 3.1, 4, 9, 218, 213, 164, 127; 355/24, 23

[56] References Cited

UNITED STATES PATENTS

| | | | |
|---|---|---|---|
| 3,061,304 | 10/1962 | Smith | 271/163 X |
| 3,260,521 | 7/1966 | Moxness | 271/127 X |
| 3,362,707 | 1/1968 | Lauren | 271/218 |
| 3,599,966 | 8/1971 | Del Vecchio et al. | 271/162 X |
| 3,689,064 | 9/1972 | Kuksa | 271/127 X |

OTHER PUBLICATIONS

Simpson, Jr., G. I. "Duplex Copier Incorporating Sorter–Collator," *IBM Technical Disclosure Bulletin*, vol. 14, No. 5, Oct. 1971, p. 1453.

*Primary Examiner*—Evon C. Blunk
*Assistant Examiner*—Bruce H. Stoner, Jr.
*Attorney, Agent, or Firm*—Fitzpatrick, Cella, Harper & Scinto

[57] ABSTRACT

A copying machine includes a pair of copy material holders which are movable relative to a feed roller for selectively feeding copy material from either of the holders. In one embodiment, one of the holders is movable from a position adjacent the feed roller to a second position in which it receives already copied sheets. In a further embodiment, one of the holders is a pivoted cassette which is normally biased to a position adjacent the feed roller. This first cassette is movable away from the feed roller in response to the positioning of the second holder, also formed as a cassette, adjacent the feed roller. The second holder is slid into position on stationary rails.

9 Claims, 15 Drawing Figures

COPYING MACHINE

BACKGROUND OF THE INVENTION

1. Field of the Invention

This invention relaates to a copying machine which is capable of forming copies on both sides of the copying sheet by a simple operation.

2. Description of the Prior Art

It has been the general practice in the art to perform copying operations only on one side of each copying sheet. However, when large quantities of copied sheets are to be kept in storage, the volume to be stored becomes twice that of books or other writings in which both sides of each leaf are printed, and hence there arises the problem of storage space, weight and the waste of material. The need for a double-sided copying machine (whereby copying can be made on both sides of each copying sheet) is also apparent when one considers copying costs.

Several double-side copying systems are now known. Among them is a system in which two sensitive drums are provided, each being designed to perform copying on one of the two sides of each copying sheet, and images are formed separately on both sensitive drums and transferred respectively to both sides of the transfer paper. This system is simple in principle, but as it requires two sets of copying apparatus, the machine in bulky and very expensive. There is also known a system in which the image for one side is first transferred from the sensitive drum to an intermediary drum and temporarily retained thereon while the image for the other side is again formed on said sensitive drum, and both images are then transferred from said drums to opposite sides of the same transfer paper. Although this system requires only one set of image forming apparatus, it involves the technical problem of performing the transfer operation twice through an intermediary drum. According to still another system known in the art, a normal copying operation (transfer and fixing) is first performed on one side of the transfer paper, and then this transfer paper is guided back to the original (starting) position or into a second paper feeder and hence again fed into the copying apparatus with the transfer paper being turned over so that the same copying operation may be practiced on the back side of the transfer paper. This system necessitates only one set of copying apparatus; the same as employed for one-side copying and hence the copying machine used therefor can be reduced in size and cost. It may therefore be said that this system is the most practical and economical.

This third system, however, still involves the difficult problems of (1) smoothly reversing the transfer paper, after completion of copying on one side, when it is again fed back into the copying apparatus (2) turning up the edges of the transfer papers, after completion of copying on one side, when they are stacked up in the paper feeder, (3) delivering the transfer papers one by one, without overlapping each other, from the paper feeder when they are again fed into the copying apparatus, (4) adapting the system to a voluminous two-side copying operation, and (5) adapting the system to a two-sided copying process in which either one-side or two-side copying can be selectively performed as needed. These outstanding problems have been a barrier to the practical application of this last system.

In order to increase efficiency and speed-up the copying work, there has also been devised a so-called cassette system in which a plurality of copying sheets can be set in a cassette. Generally, according to this cassette system, various types of copying sheets differring in size and quality are stacked in the respective cassettes, and when practicing the copying operation, the desired cassette is selected and loaded into the paper feeder unit of the copying machine. This system allows easy exchange of the copying sheets by the simple changing of cassettes. As an improvement, there has also been devised a so-called double-deck system according to which two types of cassettes, which differ in size with respect to each other, are beforehand set in the same copying machine and either of these cassettes can be easily selected by simply pushing a selection button to carry out copying on the desired sheets.

However, in actual commercial use, copying sheets of a certain size (such as A size or B size) are used predominantly, and there are few occasions where other sizes of sheets are used.

Further, according to the conventional cassette system, when using cassettes of different sizes, it becomes necessary to remove the cassette which has already been set in position and then to insert a new cassette, and in some cases, it is also necessary to replace the new cassette with the original cassette after completion of the copying operation.

SUMMARY OF THE INVENTION

The present invention has for its object to provide a copying machine which belongs in the category of the above-said cassette system but which avoids the above-mentioned problems (1) to (5) of said system and which has small size, a simple mechanism, easy operation and two-sided copying capabilities.

It is also an object of the present invention to provide a cassette which can meet the above-said conditions without compromising the good points of the conventional cassette and double-deck systems and which is also simplified in operation, compact and low in cost.

According to one aspect of the present invention, there is provided a copying machine including cassettes containing copying materials such as sensitive paper or transfer sheets and a cassette housing box or a simple rimmed board on which said copying materials can be stacked up, said rimmed board being movable to and from the first position where the copying materials can be fed from the board for a copying operation and a second position where the copying materials discharged upon completion of the copying operation are received. When copying is made only on one side of each copying sheets, the copying sheets fed from the board are simply passed through the copying apparatus, and are then immediately guided into the paper discharge tray. When two-sided copying is carried out, two rimmed boards are used, with the first board being initially set at the second position and the second board at the first position, and each copying sheet fed from the second board is passed through the copying apparatus and is delivered to the first board, and during this operation, one-side copying is performed. At this time, the copying sheet delivered to the first board is placed with its image-formed side facing downwardly. Then the first board is moved to the first position and the copying sheets, which have been completed with one-side copying, are sent from said first board through the copying apparatus and enter the discharge tray, and copying is thus made on the back side.

Thus, the copying machine according to the present invention, which is capable of performing copying on both sides of each copying sheet, has the following advantages. Firstly, when each copying sheet completed with one-side copying is discharged into a cassette in a manner shown in FIG. 2. and this cassette is moved to the next sheet feeding position, the operator can make sure, with his own eyes, whether the copying sheet discharged into and stored in the cassette 16A is correctly placed therein so that it will be properly fed from the feeding position, and further, since the cassette 16A is located outside of the copying machine body, the operator can easily adjust the position of the copying sheets in the cassette. Moreover, since said cassette 16A can be easily moved between the paper feeding position and the tray position, the copying machine is very easy to operate and also capable of making two-sided copying in great quantities in one operation. Still further, either one-side or two-sided copying can be selectively practiced as needed, and there is no need of enlarging the machine body therefor.

It is also envisaged in the present invention to provide an improved cassette mechanism that has the following features. In a condition where a certain cassette is set in the copying machine, when it is desired to obtain copies of a different size, the operator has only to insert another cassette containing the copying sheets of the desired size into the sheet feeding mechanism of the copying machine, whereby the original cassette is automatically displaced from the sheet feeding mechanism and the new cassette is set in the operative position and desired copying can be carried out. And when this new cassette is pulled out, the original cassette is again automatically returned to and set in the sheet feeding mechanism to restore the initial condition where copying with the sheets of the original size can be exercised. Thus, according to this system, a cassette containing copying sheets of a size normally used is beforehand set in the copying machine so as to usually obtain copies of normal size, and when it is desired to obtain copies of a different size, a cassette containing the sheets of desired size is simply inserted into the sheet feeding mechanism of the copying machine to perform copying with the desired size.

The present invention is not limited to the copying systems described herein as embodiments of the invention but can be applied widely to many other copying systems. It is to be also noted that since the copying sheet feeding port and discharge port are provided on the same side of the copying machine, the copying sheet passage is shortened, so that this invention can provide a small-sized and mechanically simplified copying machine.

DESCRIPTION OF THE PREFERRED EMBODIMENTS

Figure 1:
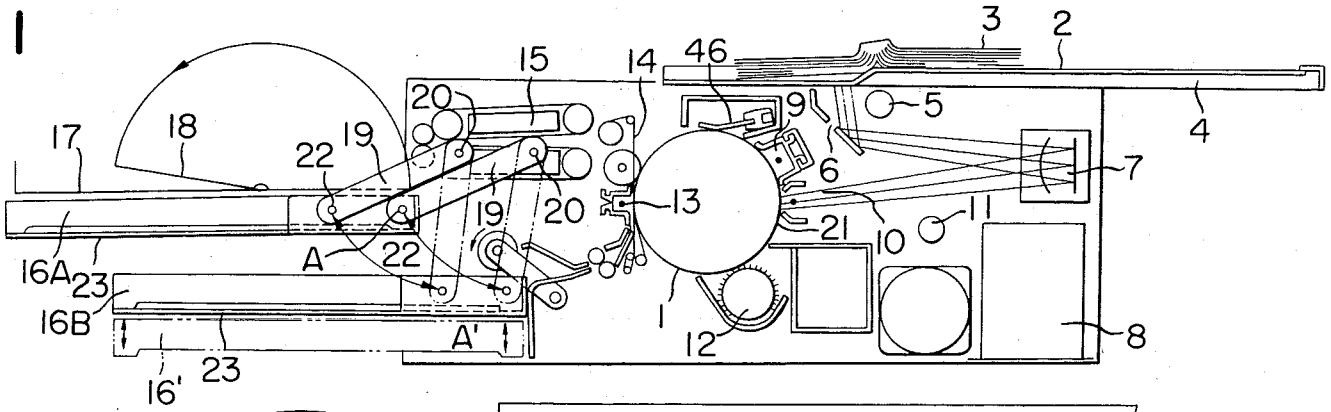
FIG. 1 is a schematic longitudinal sectional view of a copying machine according to one embodiment of the present invention.

Discussion is first made on an example of a copying machine in which the present invention can be adapted.

The copying machine shown in the drawings is a transfer type electrophotographic copying machine arranged to allow copying of two or three-dimensional objects including a voluminous manuscript, book or such.

The operation of this copying machine is described with reference to FIG. 1. When the rotating drum 1 rotates to a predetermined position, the original tray 4 carrying an original 3 on its glass plate 2 begins to move and is illuminated from below thereof by an illumination lamp 5. The image of the illuminated original is reflected by a reflector 6 and an in-mirror 7 and formed on the drum 1 in the exposure section 21. The surface of the drum 1 is coated with a blanket of sensitive material consisting of a sensitive layer and a transparent insulating layer covering said sensitive layer. Said sensitive material blanket is first charged positive by a corona discharger 9 to which a high positive voltage is applied from a high-voltage source 8, and when the drum surface reaches the exposure section 21, the image from the illumination section 5 is subjected to slit exposure and also undergoes AC destaticization by a corona discharger 10 to which a high AC voltage is applied from a high-voltage source 8. Then the image is subjected to overall exposure by an overall exposure lamp 11 to form an electrostatic latent image and then moves to the developing section 12 where the electrostatic latent image formed on the drum surface is developed by the sleeve type powder development system.

Then a transfer paper supplied from the apper feeding section adheres to the drum surface 1 and the image on the drum surface 1 is transferred to said transfer paper by a transferring means. The transfer paper to which the image has been transferred is then separated from the drum surface 1 by dint of a separation belt 14 and guided to the fixing station 15. The drum surface 1 is cleared of the remaining developer on the drum surface by a blade 46 pressed thereagainst and repeats the next copying cycle. The thus treated transfer paper is then conveyed to a cassette 16A or 16B which is detachably set in the paper feeding section at the lower left end of the copying machine.

Now the features of the present invention as adapted in the above-described copying machine are described.

Figure 2:
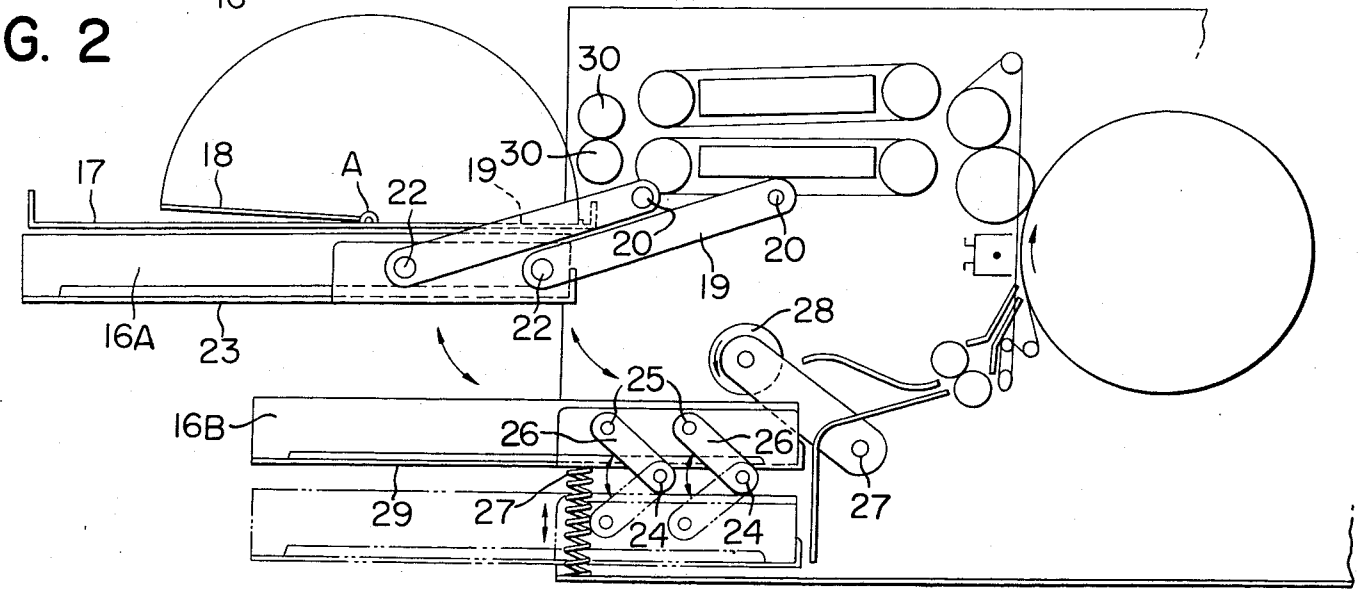
FIGS. 2 and 3 are enlarged front views of a rimmed board moving mechanism in said copying machine.

Referring to FIG. 2, the rimmed board has a cassette 16B designed to contain the copying sheets therein and a cassette holder 29 on which said cassette can be set. Rocker arms 26 are swingably secured to said cassette holder 29 by means of shafts 25. These rocker arms 26 are also pivoted by the pivots 24 on the machine body side so that the cassette holder 29 is swingable about said pivots 24 so as to be movable to and from the normal position where actual copying can be practiced and a displaced position as shown in FIG. 3.

Figure 3:
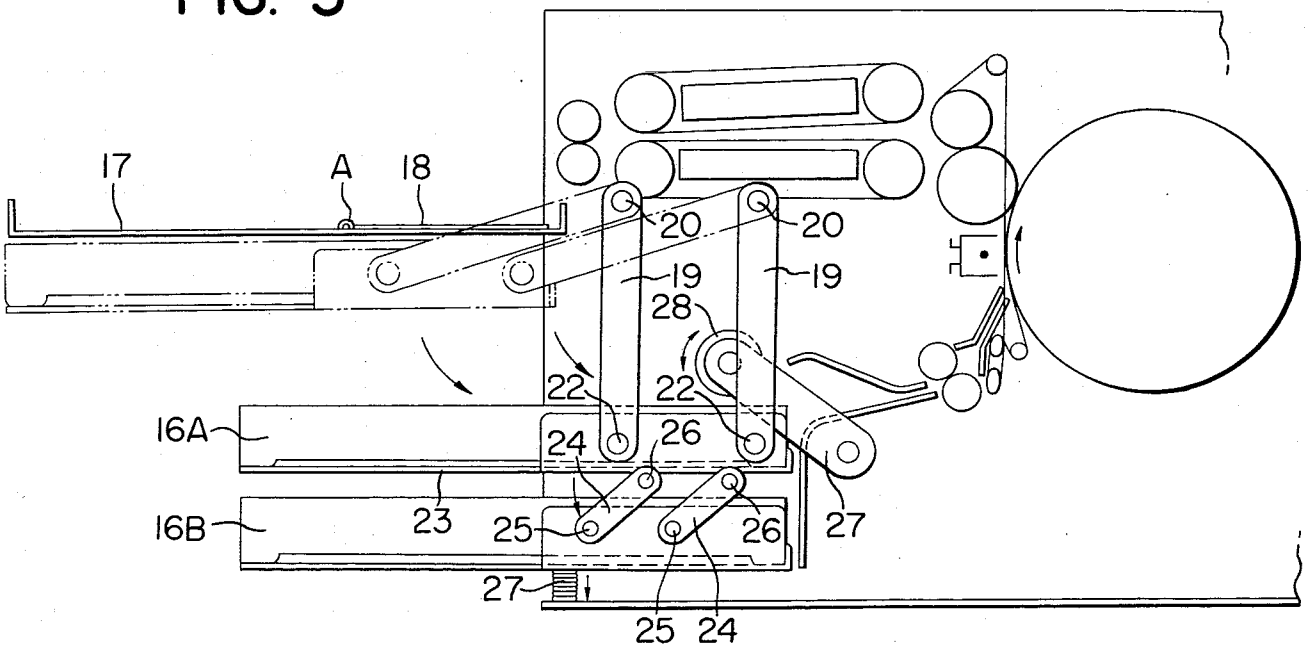

It will be also seen in FIG. 3 that the cassette 16A is set on the cassette holder 23 and rocker arms 19 are pivotally secured to said holder 23 by shafts 22. These rocker arms 19 are also pivoted by the pivots 20 on the machine body side so that the cassette holder 23 is swingable about said pivots 20 so as to be movable to and from the normal position where actual copying can be practiced and the position close to the discharge tray 17 as shown in FIG. 2.

Now the relative movements of the above-said cassettes 16A and 16B are described. In the situation of FIG. 2, the cassette 16B is set on the cassette holder 29 which is at its normal position for the actual copying operation. To perform two-sided copying, the cassette 16A is placed on the cassette holder 23 which is set at the position close to the sheet discharge tray 17 so that said holder will serve as a transfer sheet receiving tray when the transfer sheets delivered out from the cassette 16B are discharged out through the discharge rollers 30. At this time, the plate 18 of the actual transfer sheet receiving tray 17 turns about the fulcrum A in FIG. 2 to open out a part of the tray so that the cassette 16A serves as the tray to receive the copied transfer sheets discharged out through the discharge rollers. And then the holder 23 carrying said cassette 16A thereon is swung about the pivots 20 to the actual sheet feeding position as shown in FIG. 3. In the meanwhile, the cassette 16B is moved from its actual sheet feeding position shown in FIG. 2 to the displaced position shown in FIG. 3 by swinging its holder 29 about the pivots 26. At this stage, the plate 18 of the tray 17 is returned to its original position (FIG. 3) and the copying operation is again started, whereby the image is now transferred to the opposite side (back side) of the transfer sheet, and the image-transferred sheet is discharged out through the discharge rollers into the tray 17, thus completing the two-sided copying. When it is desired to use the cassette 16B, the cassette holder 23 that holds the cassette 16A therein is moved to the position shown in FIG. 2, whereby the cassette holder 29 carrying the cassette 16B therein is automatically forced back to its normal sheet feeding position shown in FIG. 2. In this case, if the plate 18 of the tray 17 is placed at the position shown in FIG. 3, ordinary one-side copying can be also accomplished in a usual way.

Here, let us discuss in greater detail the behavior of the cassette holder 29 (carrying the cassette 16B therein) which moves from the position of FIG. 2 to the position of FIG. 3 in accordance with swinging movement of the holder 23 of the cassette 16A from the position of FIG. 2 to the position of FIG. 3.

Figure 4:
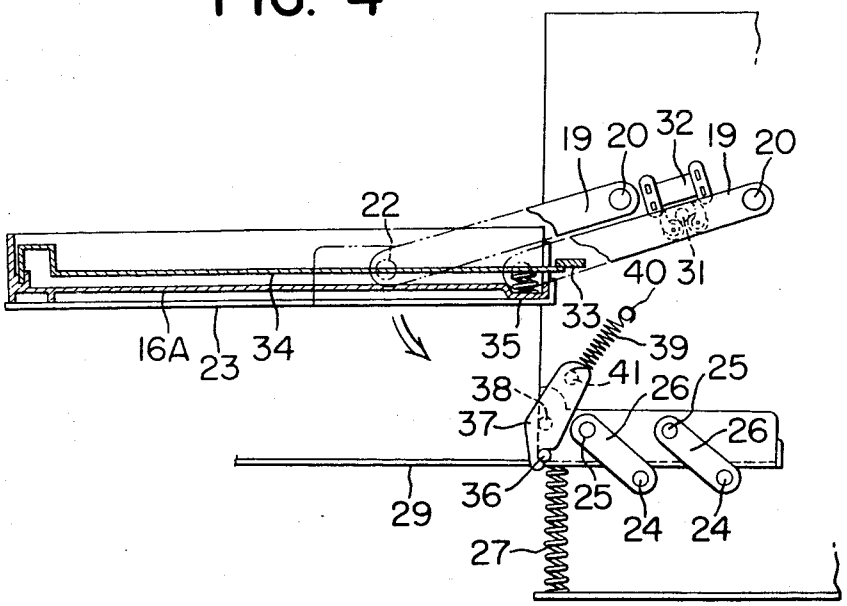

In the condition of FIG. 4, the cassette holder 29 stays at the sheet feeding position and the joggle 36 provided on said cassette holder 29 is locked by a lock lever 37. Said lock lever 37 is arranged swingably about a pivot 38 provided on the machine body side and also has secured thereto an unlocking shaft 41. This lock lever 37 is also pulled by a spring 39 whose one end is secured to said unlocking shaft 41 and the other end is hooked by a spring stop 40. On the other hand, the cassette holder 23 is placed in attachment to the sheet discharge tray and is fixed to the latter as the joggle 31 provided on each rocker arm 19 is gripped by a roller catcher 32 provided on the machine body. When the operator pushes down the cassette holder 23 in the direction of the arrow, the joggles 31 are disengaged from the roller catcher 32, allowing said cassette holder 23 to descend to the position shown in FIG. 5. Then a part of the lower portion of the cassette holder 23 hits against the unlocking shaft 41 secured to the lock lever 37 to disengage said lock lever 37 from the joggle 36, whereby the cassette holder 29 is pushed up by the spring 27. Then a protuberant portion A of the cassette holder 29 is pushed downwardly by the lower part of the cassette holder 23 and the latter assumes the sheet feeding position shown in FIG. 6. For again returning the cassette holder 23 to the tray position, the above-said operation is reversed, whereby the cassette holder 29 is locked by the lock lever 37 and the joggles 31 gripped by the roller catcher 32 to lock the cassette holder 23 to the tray position.

As for the cassette 16A, it includes a mid-plate 34 on which the transfer sheets are placed in pile, and such pile of transfer sheets on said mid-plate is pushed up by a spring 35 until said pile abuts at its top against a pawl 39'. Thus, if this cassette is used, the topmost transfer sheet of the pile is always kept at a constant height and positive sheet feed is made only when the sheet feeding roller 28 is lowered down as shown in FIG. 3.

Figure 5:
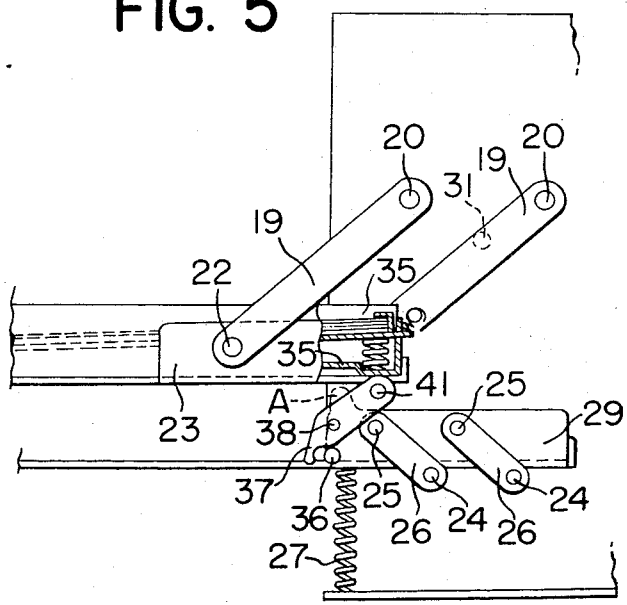
FIGS. 4 to 6 are partial enlarged front views showing the relationship of movement of the plural rimmed boards carrying the copying sheets thereon.
Figure 7:
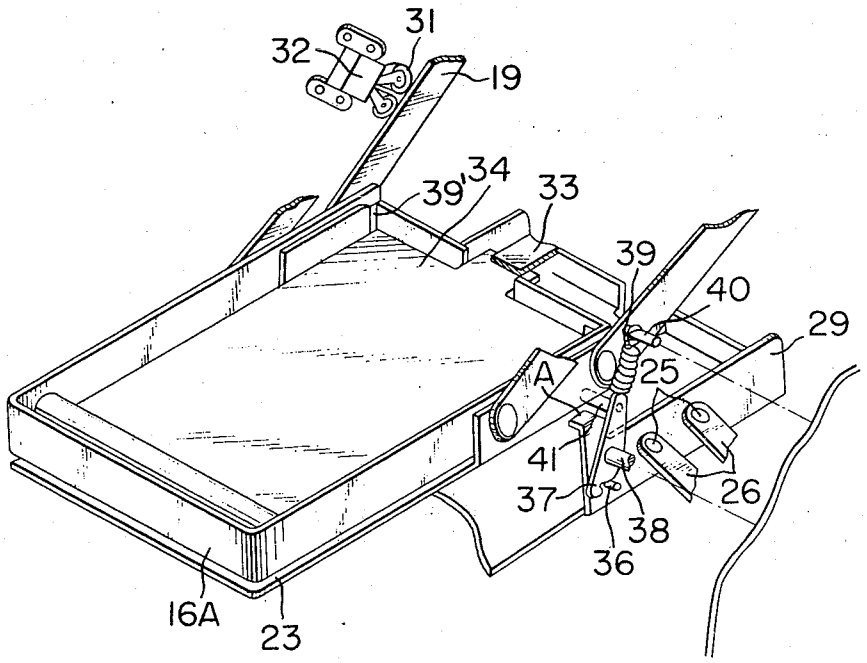
FIG. 7 is a perspective view showing a mode of control of the mid-bottom of a rimmed board.
Figure 6:
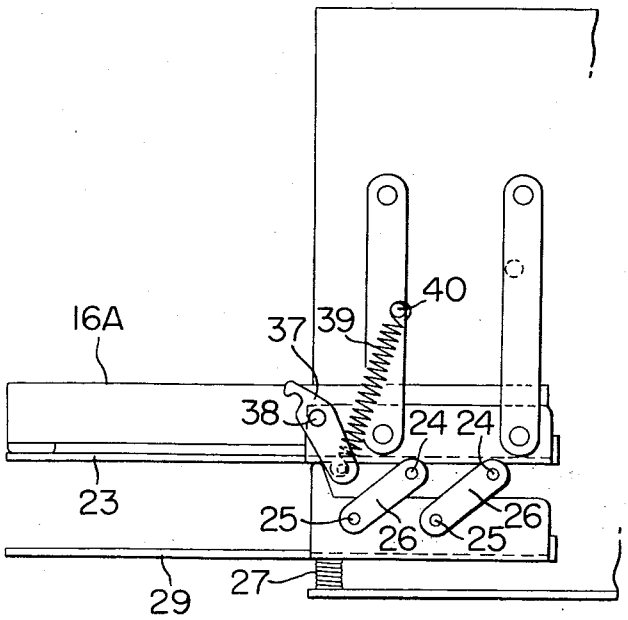

When this cassette is in the tray position shown in FIG. 4, the mid-plate 34 must be kept lowered for guiding the discharged transfer sheets into the cassette. For this purpose, a part of the mid-plate has a tab as shown in FIG. 7 so that said tab of the mid-plate is pushed down by a stopper 33 provided on the machine body side when the cassette holder 23 has just come to the tray position. Thus, if the mid-plate 34 is freed from the stopper 33 as shown in FIG. 5, the pile of tranfer sheets in the cassette is pushed up by the mid-plate, with the topmost sheet being pressed against the pawl 39' so that it may be delivered out at any time.

Figure 8:
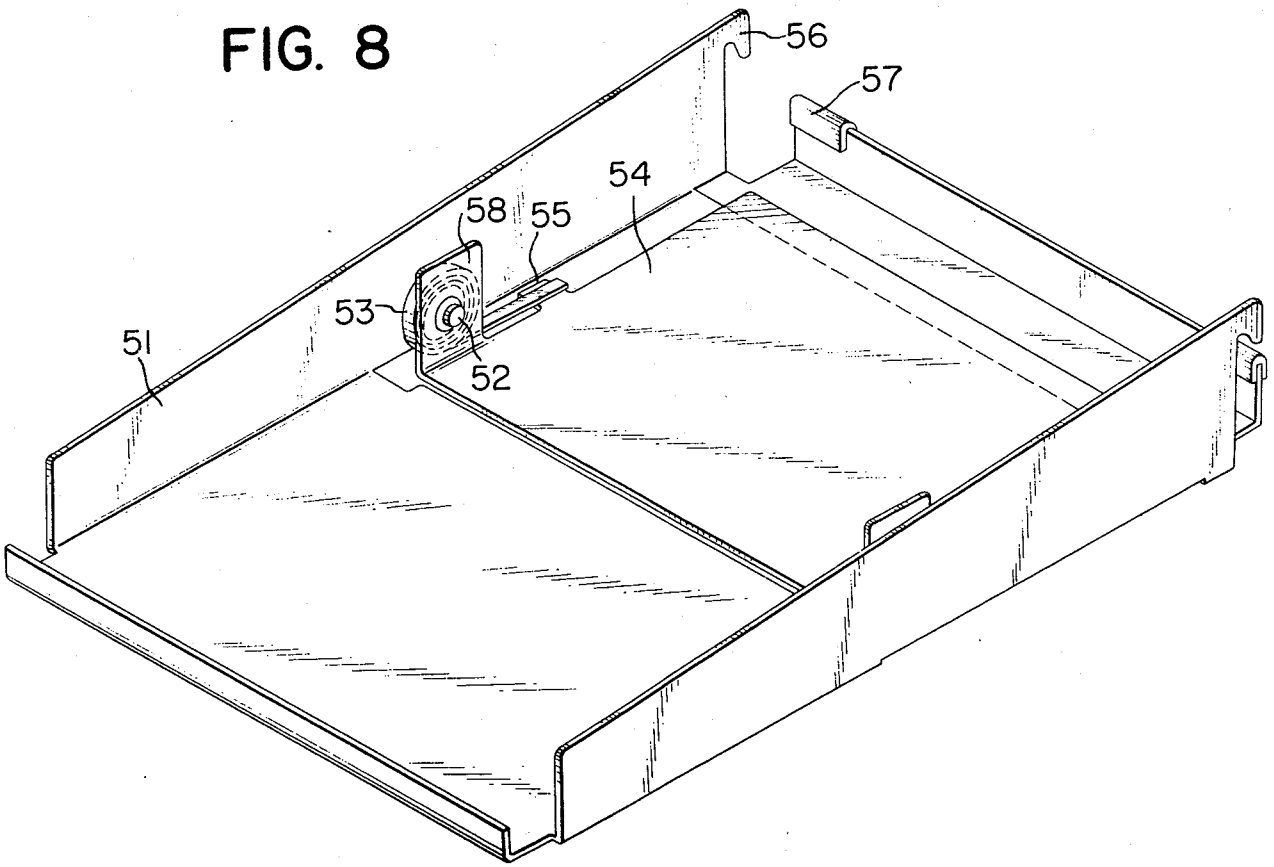
FIG. 8 is a perspective view of a discharge tray.
Figure 9:
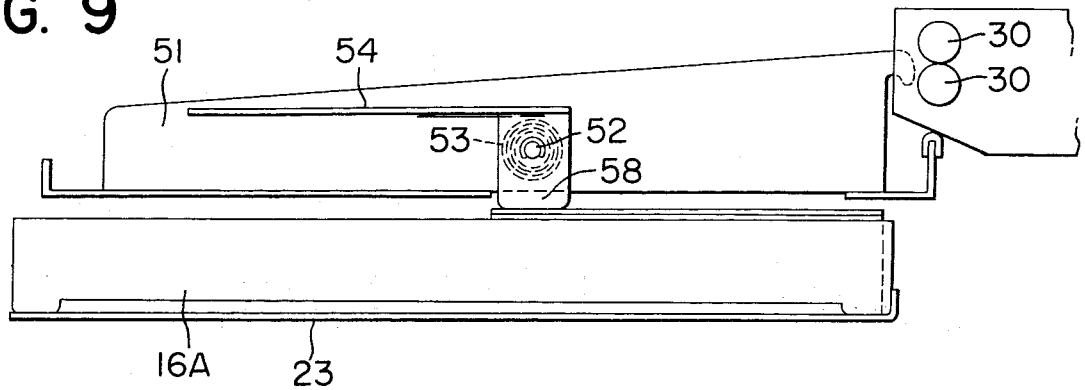
FIGS. 9 and 10 are longitudinal sectional views showing the swingable plate in the discharge tray.

Now the discussion is directed to an example of the copying material carrying trays which can be most effectively adapted in a copying machine capable of both one-side and two-side copying as needed. Referring to FIG. 8, there is shown a tray 51 provided with pivots 52 centrally at either side, and a spiral spring 53 and a plate 54 are secured to each of said pivots 52. One end of said spiral spring 53 is fixed to the pivot 52 and the other end is held by a protuberance 55 of the plate 54. The tray is also provided with hooks 56 adapted to engage with a supporting portion of the machine body for holding the tray 51 in position with the aid of cushioning members 57. When this tray is in a free state, the plate 54 is so positioned as to close the cut-out portion by the action of the spiral springs 53.

Figure 10:
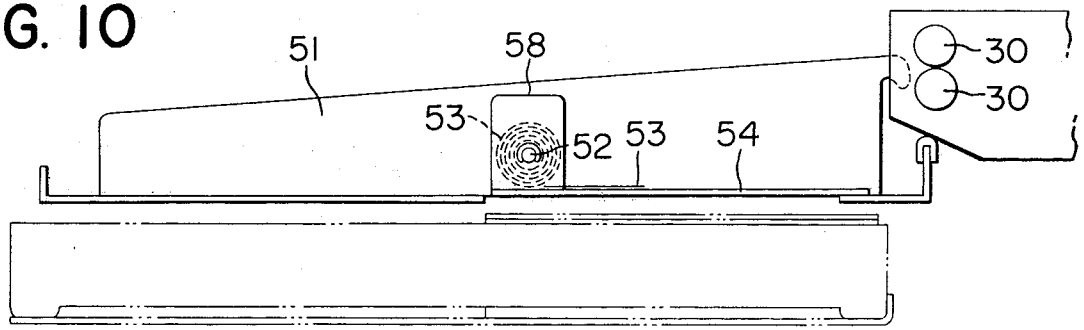

The operative relation of this tray with the cassette holder 23 is as follows. Referring to FIG. 8, in case of performing two-side copying, each copying sheet which has ended its one-side copying is first guided into the cassette 16A by turning the plate 54 about the pivots 52 to open the cutout portion of the tray. At this time, one end 58 of the plate 54 is held by the cassette holder 23 to prevent the plate 54 from returning to the original position by the action of the spiral springs 53. Then, when the cassette 16A is moved to the normal sheet feeding position (the position of FIG. 3), the cassette holder 23 which has been acting as a stopper is disengaged, allowing the plate 54 to return to the original position to close the cutout portion by the action of the spiral springs 53 as shown in FIG. 10. Thus, the copying sheets which have gone through both-side copying are properly guided into and stacked up on the tray.

As described above, according to the tray of this embodiment, closing of the cutout portion of the tray is automatically accomplished while opening thereof is effected manually. This arrangement, therefore, not only simplifies the two-side copying operation but can be also adapted for one-side copying on the copying sheets of different sizes contained in the respective cassettes 16A, 16B.

Figure 11:
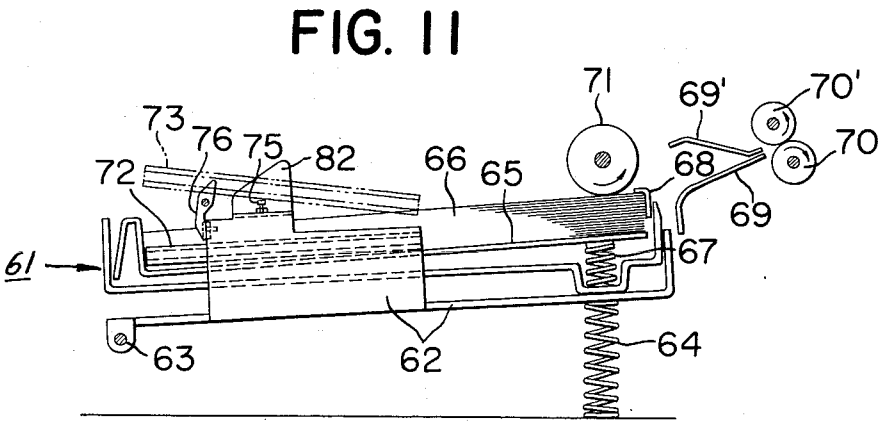
FIG. 11 is a front view showing a condition where a first cassette is set in position.
Figure 14:
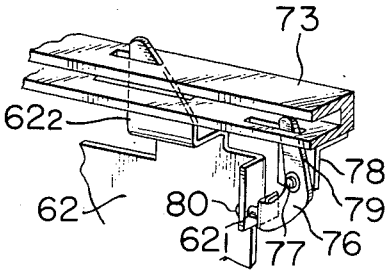
FIG. 14 is an enlarged perspective view of the locking mechanism.
Figure 15:
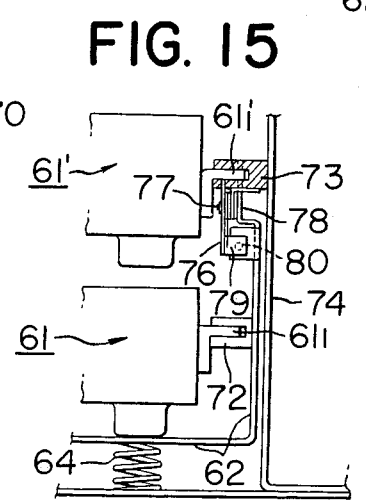
FIG. 15 is an enlarged side view of a part of the setup shown in FIG. 13.

Another embodiment of the cassette according to the present invention is now described in detail. Referring to FIG. 11, reference numeral 61 designates the cassette body (first cassette), 62 a cassette loading block provided on the copying machine side, 63 a pivot about which the cassette loading block is swingable, 64 a spring adapted to always push said cassette loading block 62 upwardly, 65 a mid-plate in the cassette for loading a pile of copying sheets 66 thereon, said mid-plate being always pushed upwardly by a spring 67, 68 a swingable separating pawl disposed overhanging the upper front end of the pile of copying sheets 66, 69 and 69' the sheet guides for guiding into the machine each copying sheet delivered out from the cassette by a sheet delivery roller 71 provided on the machine side, 70 and 70' the timing rollers for trueing up the leading end of the copying sheet and the leading end of the image, 72 a guide rail fixed to the cassette loading block 62 for setting the cassette body 61 in position, 73 a guide rail fixed to a side plate 74 (see FIG. 15) of the copying machine for setting another cassette 61' (second cassette same as the first cassette in internal construction) in position, 75 a stopper of the cassette loading block 62 pushed up by the spring 64 so as to abut against said rail 73 and adapted to determine the upper threshold position of the cassette loading block 62, and 76 a lever for locking the positioned cassette loading block 62, said lever being secured to a shaft 77 calked to a lever fixing plate 78 secured to the rail 73 as shown in FIG. 14. This lever is also always pressed in the direction of arrow by a spring 79. When the cassette loading block 62 has just come to the setting position, a pin 80 calked to said lever 76 fits in a hole $62_1$ formed at a part of said block 62, and under this condition, the cassette loading block 62 is fixed in position.

Thus, when the cassette loading block 62 is not loaded with any of the cassettes 61, 61', said block 62 is swung up about the pivot 63 by the spring 64 until the stopper 75 abuts against the rail 73, and the pin 80 of the lever 76 fits in the hole $62_1$ in the block 62 to lock the latter. Under this condition, the cassette 61 containing the copying sheets 66 of a size of high use frequency is pushed into position by fitting the guide fin $61_1$ in the guide rail 72 on the cassette loading block 62, whereby the copying sheet side of the cassette 61 is placed in contact with the sheet delivery roller 71 so that the topmost sheet can be delivered out at any time (FIG. 11).

Figure 12:
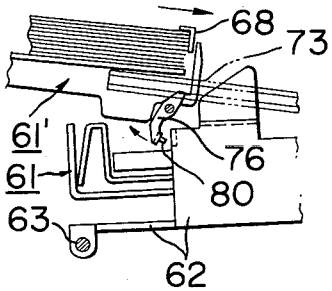
FIG. 12 is a front view of a principal part of the cassette setting mechanism, showing the step of setting a second cassette in the operative position.
Figure 13:
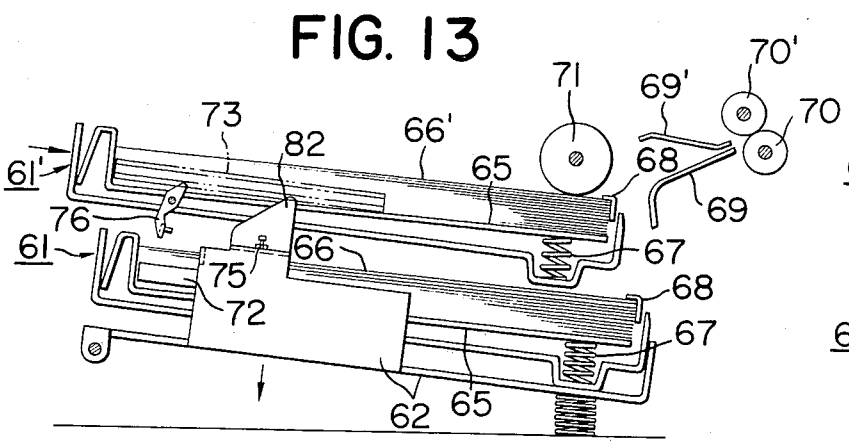
FIG. 13 is a front view showing the condition where the second cassette has been set in position.

When it is desired to obtain copies of a different size, another (second) cassette 61' containing the copying sheets of the desired size is inserted by fitting the guide fin $61'_1$ thereof in the rail 73 while keeping the first cassette 61 in the loaded state. As the second cassette is pushed into position, the lever 76 is pushed by the guide fin $61'_1$ to turn against the resisting force of the spring 79 to let the pin 80 disengage from the hole $62_1$ in the block 62, bringing the cassette loading block 62 into a condition where said block is retained only by the push-up force of the spring 64 (see FIG. 12). As the cassette is further pushed in, a part $62_1$ of the cassette loading block 62 is pushed by the guide fin $61'_1$ and the block 62 is swung down about the pivot 63 against the opposing force of the spring 64 to let the cassette 61 move away from the passage of the cassette 61', and ultimately, the copying sheet side 66' of the cassette 61' is placed in contact with the sheet delivery roller 71 so that the topmost sheet can be delivered out at any time (FIG. 13).

Thus, copying on the copying sheets of a desired size can be made possible by merely inserting the cassette 61' containing the copying sheets of the desired size with no need of taking out the first cassette 61, and if the second cassette 61' is removed, the first cassette 61 is automatically returned to its original position of FIG. 11 by the push-up force of the spring 64 and locked at this position, allowing immediate copying operation with this cassette 61. Copying with the cassette 61' is also possible when such cassette 61' is set into position along the rail 73, with the cassette 61 being not loaded on the loading block 62.

Thus, according to this embodiment, it needs to provide only one set of sheet delivery roller 71, guides 69, 69', and timing rollers 70, 70', and further, switchover of the size can be effected merely by insertion and removal of only one cassette. That is, in case of changing the copy size, this device can save the trouble of first taking out the initially loaded cassette and then inserting another cassette containing the copying sheets of the desired size, and then, after completion of copying, again changing said another cassette with the original one as in the case of the conventional cassettes. In this case, it is desirable that the rail portions $61_1$, $61'_1$ of the cassettes 61, 61' and the guide rail portions 72, 73 on the machine body are of a same configuration so that the cassettes 61 and 61 can be easily interchanged with each other. Also, the locking mechanism and the cassette loading block push-down mechanism may be provided in combination with the guides on both sides of the cassette as shown in FIG. 14.

The present invention is not limited in its adaptation to the copying machines as heretofore described but can be used as cassette loader for printing machines and other like apparatuses.

We claim:

1. A copying apparatus comprising:

copy processing means for reproducing an image of an original on a copy material;

first copy material holding means for carrying the copy material to be fed into said copy processing means, means mounting said first copy material holding means for movement between a feeding position wherein the copy material carried thereby is fed into said apparatus and a receiving position wherein the copy material discharged out of said copy processing means is received by the first holding means;

second copy material holding means for carrying the copy material to be fed into said copy processing means, means mounting said second copy material holding means for movement between said feeding position wherein the copy material carried thereby is fed into said apparatus and a resting position disposed away from said feeding position; and means for placing said second copy material holding means at said resting position when said first copy material holding means is at said feeding position and for placing said first holding means at said receiving position when said second holding means is at said feeding position.

2. An apparatus according to claim 1, wherein said first and second copy material holding means include cassettes which are detachably mounted to said copying apparatus.

3. An apparatus according to claim 1, further comprising means for discharging the copy material so that the reproduced image faces upwardly.

4. An apparatus according to claim 1, further including a cassette detachably mounted to said first copy material holding means, said cassette being provided with an inner plate operative to carry the copy material; and means for holding said inner plate adjacent the botom of the cassette when said first copy material holding means is at its receiving position.

5. An apparatus according to claim 1, further comprising tray means for receiving the copy material discharged out of said copy processing means when said first copy material holding means is at said feeding position.

6. An aparatus according to claim 5, wherein said tray means includes plate means movable between an open and a closed position for permitting the copy material to be discharged to said first copy material holding means when the latter is at said receiving position and said plate means is disposed in its said open position.

7. A copying apparatus according to claim 6, further comprising means for moving said plate means to its said closed position in response to the movement of said first cassette holder means to the feeding position, wherein said tray means is operative to continue to receive and store the copy material.

8. A copying apparatus comprising:

copy processing means for reproducing an image of an original on copy material;

first and second cassette holder means mounted on said apparatus, said second holder means being normally positioned at a feeding station;

first and second cassettes detachably mountable respectively on said first and second holder means and adapted to carry copy material to be fed into said copy processing means at said feeding station;

said second cassette holder means including pivotable mounting means for moving said second cassette mounted on said second holder means away from said feeding station in response to mounting said first cassette on said first holder means and for moving said second cassette back to said feeding station when said first cassette is removed from said first holder means.

9. An apparatus according to claim 8, wherein said first cassette holder means includes rails means for sliding said first cassette to said feeding station.

* * * * *

UNITED STATES PATENT AND TRADEMARK OFFICE

CERTIFICATE OF CORRECTION

PATENT NO. : 3,989,236

DATED : November 2, 1976

INVENTOR(S) : SHIGEHIRO KOMORI, MASAO ARIGA, HIROSHI NITANDA

It is certified that error appears in the above-identified patent and that said Letters Patent are hereby corrected as shown below:

Column 1, line 6, "relaates" should read --relates--.

Column 2, line 52, "sheets" (first occurrence) should read --sheet--.

Column 8, line 2, "$62_1$" should read --$62_2$--.

Column 9, line 16, "botom" should read --bottom--.

Column 9, line 23, "aparatus" should read --apparatus--.

Signed and Sealed this

Eighth Day of February 1977

[SEAL]

*Attest:*

RUTH C. MASON
*Attesting Officer*

C. MARSHALL DANN
*Commissioner of Patents and Trademarks*